US011641907B2

(12) United States Patent
Barry et al.

(10) Patent No.: US 11,641,907 B2
(45) Date of Patent: May 9, 2023

(54) FOOTWEAR

(71) Applicant: OUMOU BARRY LLC, Jersey City, NJ (US)

(72) Inventors: Oumou H. Barry, Jersey City, NJ (US); James Williamson, Leicester (GB)

(73) Assignee: OUMOU BARRY LLC, Jersey City, NJ (US)

( * ) Notice: Subject to any disclaimer, the term of this patent is extended or adjusted under 35 U.S.C. 154(b) by 0 days.

(21) Appl. No.: 17/252,790

(22) PCT Filed: Jun. 20, 2019

(86) PCT No.: PCT/EP2019/066417
§ 371 (c)(1),
(2) Date: Dec. 16, 2020

(87) PCT Pub. No.: WO2019/243553
PCT Pub. Date: Dec. 26, 2019

(65) Prior Publication Data

US 2021/0259362 A1 Aug. 26, 2021

(30) Foreign Application Priority Data

Jun. 22, 2018 (GB) ..... 1810307

(51) Int. Cl.
*A43B 21/42* (2006.01)
*A43B 21/48* (2006.01)
*A43B 3/24* (2006.01)

(52) U.S. Cl.
CPC ..... *A43B 21/42* (2013.01); *A43B 3/246* (2013.01); *A43B 21/48* (2013.01)

(58) Field of Classification Search
CPC ..... A43B 21/42; A43B 21/48; A43B 21/52; A43B 3/246
See application file for complete search history.

(56) References Cited

U.S. PATENT DOCUMENTS 1,829,253 A * 10/1931 Zubia ..... A43B 21/48 36/42
3,664,041 A 5/1972 Frattallone
(Continued)

FOREIGN PATENT DOCUMENTS

FR 1263966 A 6/1961
GB 2426426 A 11/2006
(Continued)

OTHER PUBLICATIONS

PCT International Search Report for PCT/EP2019/066417 dated Sep. 18, 2019.
PCT Written Opinion for PCT/EP2019/066417, dated Sep. 18, 2019.

*Primary Examiner* — Ted Kavanaugh
(74) *Attorney, Agent, or Firm* — Louis Woo

(57) ABSTRACT

An interchangeable heel for a shoe wherein the interchangeable heel includes a removable heel sleeve and a heel post which is mounted on the shoe wherein the heel sleeve is releasably mounted on the heel post by an opposed lock mechanism which includes a catch mechanism on one side of the interchangeable heel and a biasing mechanism on an opposite side of the interchangeable heel wherein the biasing mechanism includes a biasing member which is provided on the heel post wherein the biasing member is arranged to engage the removable heel sleeve; a shoe having the interchangeable heel; and a removable heel sleeve for use in the interchangeable heel according to the invention.

21 Claims, 4 Drawing Sheets

(56) References Cited

U.S. PATENT DOCUMENTS

| | | | | |
|---|---|---|---|---|
| 4,805,320 | A * | 2/1989 | Goldenberg | A43B 21/47 36/36 R |
| 5,524,365 | A * | 6/1996 | Goldenberg | A43B 21/36 36/36 C |
| 7,185,448 | B2 * | 3/2007 | Schupbach | A43B 21/48 36/15 |
| 7,578,075 | B1 * | 8/2009 | Kemp | A43B 21/38 36/100 |
| 8,925,218 | B2 * | 1/2015 | Anderson | A43B 3/246 36/100 |
| 2002/0133980 | A1 | 9/2002 | Pan et al. | |
| 2007/0163149 | A1 | 7/2007 | Urbach | |
| 2008/0196279 | A1 | 8/2008 | Epping | |
| 2008/0235991 | A1 | 10/2008 | Visser | |
| 2009/0183391 | A1 * | 7/2009 | Gallegos | A43B 13/37 36/88 |
| 2009/0282702 | A1 | 11/2009 | Brown et al. | |
| 2013/0097893 | A1 | 4/2013 | Robinovitch | |
| 2013/0312285 | A1 | 11/2013 | Castello et al. | |
| 2014/0096413 | A1 * | 4/2014 | Anderson | A43B 21/42 36/100 |
| 2015/0128457 | A1 | 5/2015 | O'Dell | |
| 2016/0015130 | A1 | 1/2016 | Knox | |
| 2016/0235163 | A1 | 8/2016 | Alander | |
| 2017/0042276 | A1 * | 2/2017 | Alan | A43B 21/48 |
| 2017/0318895 | A1 | 11/2017 | Thomasson et al. | |
| 2017/0347751 | A1 * | 12/2017 | Leiber | A43B 21/437 |

FOREIGN PATENT DOCUMENTS

| | | | |
|---|---|---|---|
| GB | 2519580 | A | 4/2015 |
| KR | 20100039305 | A | 4/2010 |
| WO | 8806010 | A1 | 12/1987 |
| WO | 2012054981 | A2 | 5/2012 |
| WO | 14023783 | A1 | 8/2013 |
| WO | 2014020175 | A1 | 2/2015 |
| WO | 15056279 | A1 | 4/2015 |
| WO | 15080301 | A1 | 6/2015 |
| WO | 2015145153 | A1 | 10/2015 |
| WO | 16053077 | A1 | 4/2016 |

* cited by examiner

FOOTWEAR

The present invention relates to generally to the field of footwear with interchangeable heels, and in particular articles of footwear that allow for the heel to be interchanged quickly and conveniently.

Either for aesthetic or for practical reasons it is desirable to be able to alter the appearance of articles of footwear. A wearer may wish to change the appearance of their footwear to suit a different occasion. They may wish to match their footwear to a particular outfit or style to keep up with current trends. The heel portion of a pair of shoes may become damaged and need to be replaced or repaired.

There are many patent publications which relate to an interchangeable heel for a shoe (also known as an interchangeable shoe heel cover). Generally, the disclosed solutions to the problem of providing a shoe with an interchangeable shoe heel suffer from the problems that the shoe heels do not pass SATRA Test TM113 for "Measurement of the Strength of Attachment of Heels to Footwear and the Backpart Rigidity of Such Footwear" (1996) and are not suitable for commercialisation because part or all of the mechanism is provided on the replaceable heel cover. As a result, the cost of manufacture of the replaceable heel cover becomes too expensive in comparison to the expected price point for the consumer.

According to the invention there is provided an interchangeable heel for a shoe wherein the interchangeable heel comprises a removable heel sleeve and a heel post which is mounted on the shoe wherein the heel sleeve is releasably mounted on the heel post by an opposed lock mechanism which comprises a catch mechanism on one side of the interchangeable heel and a biasing mechanism on an opposite side of the interchangeable heel wherein the biasing mechanism comprises a biasing member which is provided on the heel post wherein the biasing member is arranged to engage the removable heel sleeve.

According to the invention there is also provided a shoe comprising an interchangeable heel according to the invention.

According to the invention there is further provided a removable heel sleeve for use in the interchangeable heel according to the invention wherein the heel sleeve forms a catch formation or a catch aperture to form part of the catch mechanism for engaging the heel post of the interchangeable heel according to the invention.

Advantages of the invention include that the shoe to which the interchangeable heel is attached generally fails in the SATRA Test TM113 before the interchangeable heel; the interchangeable heel withstands a tensile force of at least 600N; that the replaceable or interchangeable heel sleeve which may be used to change the appearance of a shoe is relatively cheap to manufacture because the biasing member which is the main functional part of the opposed lock mechanism is provided on the heel post; and that the heel sleeve may be moulded from a thermoplastic material and comprises no moving parts.

In some embodiments, the heel catch mechanism may comprise a catch aperture and a catch formation. In some embodiments, lock mechanism comprises a lock formation for engaging the biasing member provided on the removable heel sleeve, the biasing member, and a heel post lock aperture shaped to receive the biasing member.

In some embodiments, the opposed lock mechanism consists of a catch mechanism on one side of the interchangeable heel and a biasing mechanism on an opposite side of the interchangeable heel. In some embodiments, the opposed lock mechanism has (or consists of) a single catch mechanism on one side of the interchangeable heel and a single biasing mechanism on an opposite side of the interchangeable heel. In some embodiments, the interchangeable heel has a single opposed lock mechanism. In some embodiments, the single opposed lock mechanism consists of a catch mechanism on one side of the interchangeable heel and a biasing mechanism on an opposite side of the interchangeable heel. In some embodiments, the single opposed lock mechanism has (or consists of) a single catch mechanism on one side of the interchangeable heel and a single biasing mechanism on an opposite side of the interchangeable heel.

In some embodiments, the interchangeable heel may comprise an upper heel and a lower heel and the opposed lock mechanism may be provided on the upper heel. In some embodiments, the opposed lock mechanism may be provided on the front and rear sides of the heel. In some embodiments, the catch mechanism may be provided on the rear side of the heel and the biasing mechanism may be provided on the front side of the heel. Advantages of such an arrangement include that the typical forces exerted on a shoe heel such as a rearward force applied to the heel tip has the effect of increasing the engagement of the catch mechanism, particularly when the catch mechanism is provided on the upper heel.

In some embodiments, the catch mechanism may comprise a catch formation provided on one of the heel post or heel sleeve and a catch aperture shaped to receive the catch formation formed by the other of the heel post or heel sleeve. In some embodiments, the catch mechanism may comprise a catch formation provided on the heel sleeve and a catch aperture formed by the heel post.

In some embodiments, the biasing member may be in the form of a leaf spring or a coil spring. In some embodiments, the biasing mechanism may comprise the biasing member and a lock aperture formed on heel post and shaped to receive the biasing member. In some embodiments, the biasing member may be in the form of leaf spring and may be attached to the heel post above the lock aperture. In some embodiments, the biasing member may be in the form of a coil spring and may be attached within lock aperture. In some embodiments, the biasing member may be formed from a tempered metal such as spring steel, e.g. stainless spring steel.

In some embodiments, the heel post may have an angled head surface for engaging the shoe sole and the catch aperture may be provided on the rear side of the angled head surface.

In some embodiments, the lock aperture and biasing member are provided on a curved heel breast on the upper part of heel post.

In some embodiments, the removable heel sleeve forms a heel sleeve aperture for receiving the heel post. In some embodiments, the removable heel sleeve forms a recess for receiving the heel tip.

In some embodiments, the removable heel sleeve may have an angled head for engaging the shoe sole and the catch formation may be provided on the rear side of the angled head. In some embodiments, the catch formation may be formed from a thermoplastic material such as an engineering thermoplastic, e.g. polyoxymethylene (POM), acrylonitrile butadiene styrene (ABS), polycarbonate, and/or polyamide (nylon, such as nylon 6 or nylon 66).

In some embodiments, the removable heel sleeve may have a lock formation for engaging the biasing member of the biasing mechanism. In some embodiments, the lock formation may be provided on curved heel breast of removable heel sleeve.

In some embodiments, the interchangeable heel comprises an anti-twist mechanism which comprises one or more guidance slots provided on one of the heel post and heel sleeve and one or more guidance formations provided on the other of the heel post and heel sleeve. In some embodiments, the guidance slots may be shaped to receive the guidance formations and to facilitate movement of the heel sleeve to remove it from the heel post but to prevent other movement of the heel sleeve.

In some embodiments, the one or more guidance slots may be provided on the heel post. In some embodiments, a guidance slot is provided on each side of heel post lock aperture. In some embodiments, the one or more guidance slots have an aperture which is orientated towards the heel tip such when the removable heel sleeve is slid onto the heel post, the guidance formations are inserted into the guidance slots. In some embodiments, the heel sleeve has an angled head and the one or more guidance formations are provided on the heel breast side of the angled head of removable heel sleeve.

In use, the opposed lock mechanism are engaged when the heel sleeve is mounted on heel post by sliding the heel sleeve over the heel post such that the catch mechanism is engaged. The heel sleeve engages the heel post biasing member such that the biasing member urges the heel sleeve in a direction away from the catch mechanism so as to activate the catch mechanism. To release the opposed lock mechanism, pressure may be applied to a part of the heel sleeve near the biasing member to force the biasing member against the heel post such that the catch mechanism is disengaged and the heel sleeve may be removed from the interchangeable heel.

In some embodiments, the heel post may be formed from a moulded resilient plastics material. In some embodiments, the heel post may form a heel post pin channel for receiving the heel pin.

In some embodiments, the shoe may have a shoe body and a shoe sole. In some embodiments, the interchangeable heel may comprise a shoe heel pin to provide structural strength for the heel; the shoe heel pin may be made from steel. In some embodiments, the interchangeable heel may comprise a shoe heel tip; the shoe heel tip may be formed from rubber and may provide a non-slip lower surface for the heel.

In some embodiments, the interchangeable heel may be a high, mid or low heel. In some embodiments, the interchangeable heel may be in the form of a stiletto, cone, spool, chunky (also known as a block), wedge (where the space 24 between the heel 10 shown in FIG. 1 and the sole 16 is filled by the wedge heel), or comma heel.

The invention will now be illustrated with reference to the following Figures of the accompanying drawings which are not intended to limit the scope of the claimed invention:

Figure 1:
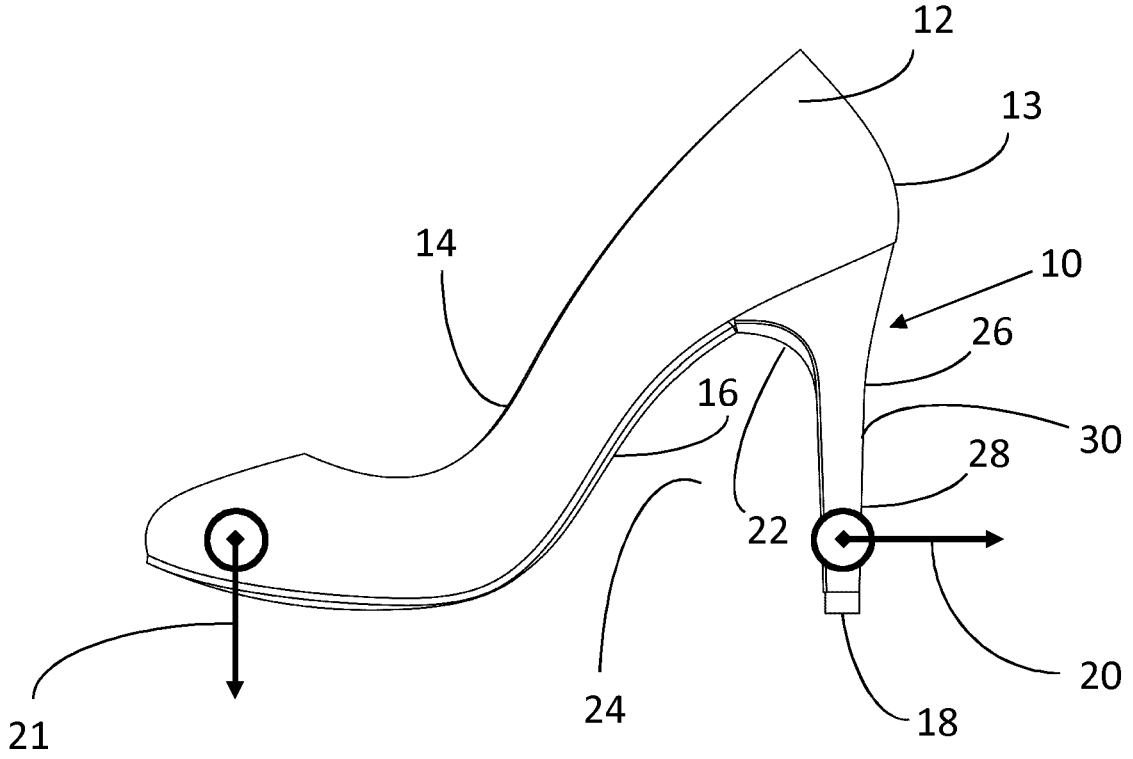
FIG. 1 shows a schematic side view of a high heeled shoe incorporating the interchangeable heel according to the invention.
Figure 2:
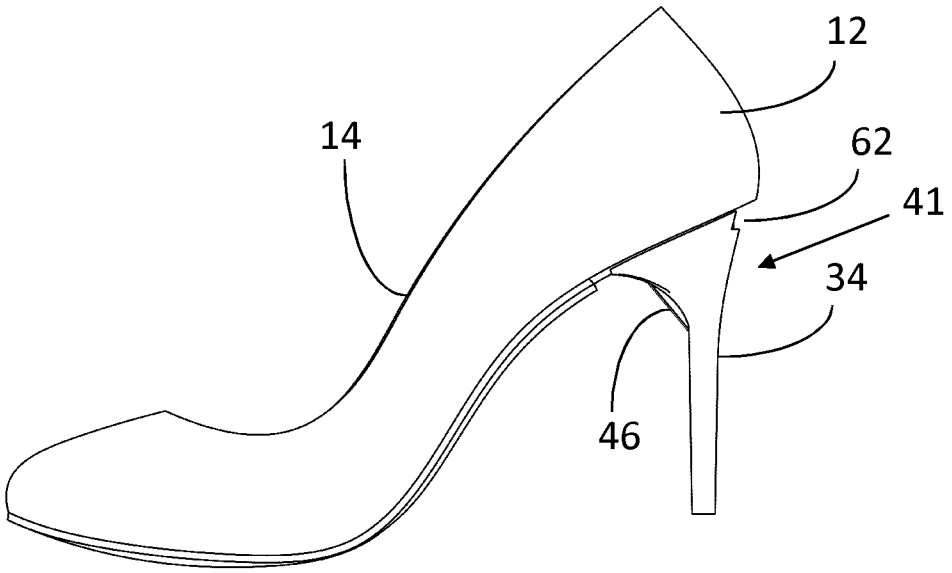
FIG. 2 shows a partial schematic side view of a high heeled shoe incorporating the interchangeable heel according to the invention where the heel sleeve has been removed.
Figure 3:
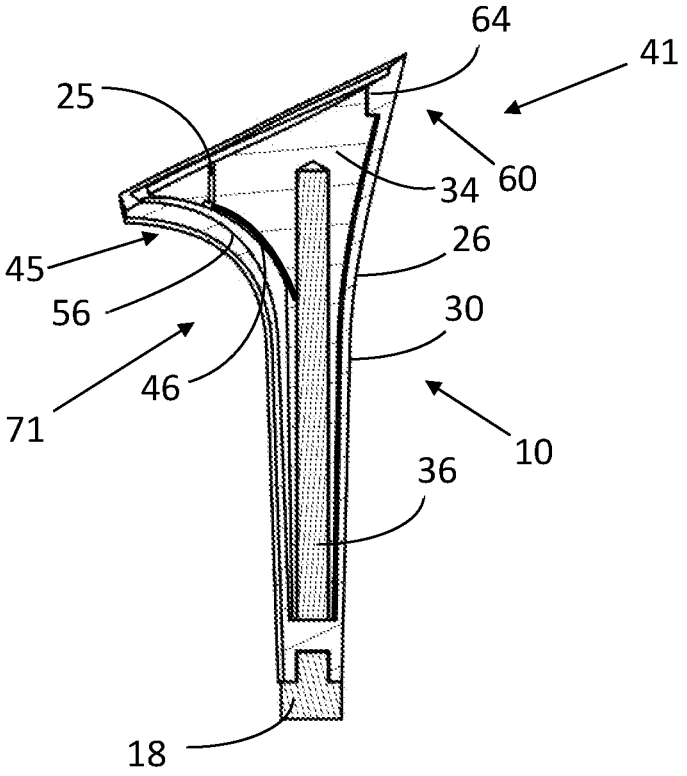
FIG. 3 shows a schematic cross-sectional view of the interchangeable heel according to the invention.

An interchangeable heel according to the invention is indicated generally at 10 on FIGS. 1 and 3 of the accompanying drawings. Interchangeable heel 10 is shown in FIG. 1 mounted on a high heel shoe 12 which has a shoe body 14 and a shoe sole 16. Shoe body 14 comprises the usual parts of an upper part of a shoe such as a vamp, quarter, toe cap, lining, throat etc and may be formed from a natural or synthetic material. The present invention does not affect the design of the shoe body 14: generally speaking, any design of the shoe body 14 may be used with the interchangeable heel 10.

Interchangeable heel 10 is in the shape of a high heel having a head in the form of an upper heel 26 and a body in the form of a lower heel 28. Upper heel 26 has an inverted truncated pyramidal shape having an angled head surface 35 which is shaped to engage the shoe sole 16. In use, the shoe 12 is attached to angled head surface 35 of interchangeable heel 10 by means of self-tapping screws (not shown). Upper heel 26 has a concave heel breast 22 (which is the front side of the upper heel 26 which faces the shoe sole 16). Lower heel 28 which has a tubular shape with a substantially square cross-section. The shoe 12 has a shoe back 13 and a space 24 between the heel and the sole.

As shown in FIG. 3, interchangeable heel 10 comprises a removable heel sleeve 30, a shoe heel post 34, a shoe heel pin 36, and a shoe heel tip 18 wherein the removable heel sleeve 30 is removable from the shoe heel post 34 by means of an opposed lock mechanism 41 which is provided on the upper heel 26. In this way, the removable heel sleeve 30 is an interchangeable removable heel sleeve 30. Removable heel sleeve 30 may be formed from a moulded plastics material. Shoe heel pin 36 is typically made from steel and provides structural strength for the heel 10. Shoe heel tip 18 is generally formed from rubber and provides a non-slip lower surface for the heel 10.

In an alternative embodiment, the interchangeable heel 10 may also be used on a shoe 12 having a different heel height, for example a mid or low heel having a shorter lower heel 28 with a shorter heel pin 36 wherein the lower parts 26,126 of the heel post 34 and removable heel sleeve 30 are shaped accordingly. It will be appreciated that the function of the invention is not dependent upon the external shape of the removable heel sleeve 30. The interchangeable heel 10 may be used with any external shape of removable heel sleeve 30. In an alternative embodiment, the interchangeable heel 10 or the removable heel sleeve 30 may be in the form of a stiletto, cone, spool, chunky (also known as a block), wedge (where the space 24 between the heel 10 shown in FIG. 1 and the sole 16 is filled by the wedge heel), or comma heel. In an alternative embodiment, the removable heel sleeve 30 may be formed from metal (such as aluminium), a synthetic material, and/or a natural material (such as wood).

Figure 4:
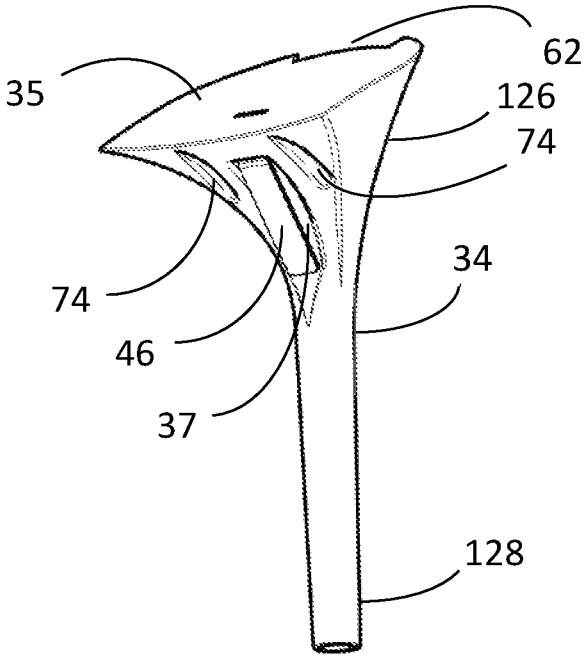
FIG. 4 shows a schematic isometric view of a shoe heel post for use in the interchangeable heel according to the invention.
Figure 5:
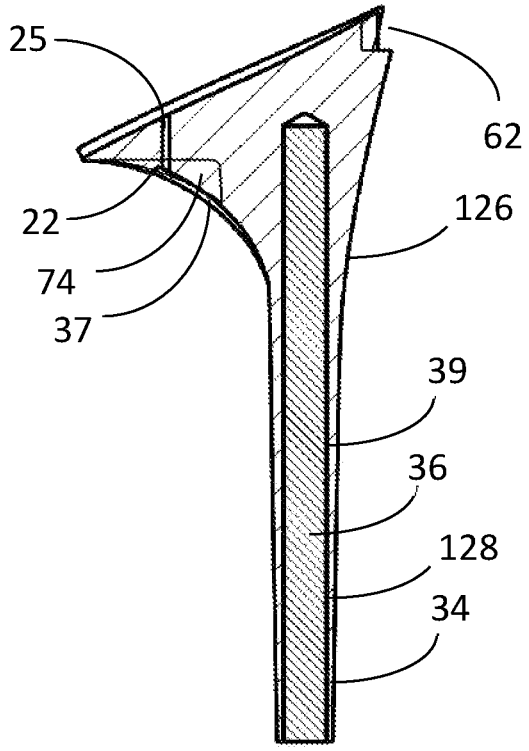
FIG. 5 shows a schematic rear elevation of the shoe heel post for use in the interchangeable heel according to the invention.

Shoe heel post 34 is shown in more detail in FIGS. 4 and 5. Shoe heel post 34 has an upper part 126 and a lower part 128. Shoe heel post 34 is formed from a moulded resilient plastics material. The upper and lower parts 126,128 of heel post 34 form a heel post pin channel 39 for receiving the shoe heel pin 36. The upper part 126 of heel post 34 provides part of the opposed lock mechanism 41. On the shoe back side 13 of the angled head surface 35 of the upper part 126 of heel post 34, a heel post catch aperture 62 is provided which receives a heel sleeve catch formation 64. On the opposing curved heel breast 22 on the upper part 126 of heel post 34, a heel post lock aperture 37 and a heel post biasing member 46 are provided. The heel post biasing member 46 is in the form of a metal leaf spring which is attached to the heel post 34 in biasing member slot 25 which is positioned above heel post lock aperture 37. The heel post lock aperture 37 is shaped to receive the heel post biasing member 46 in use. For example, the heel post biasing member 46 may be formed from a tempered metal such as spring steel, e.g. stainless spring steel. Heel post biasing member 46 is arranged to provide a biasing force in the direction of the shoe sole 16 so as to engage the removable heel sleeve 30. To each side of heel post lock aperture 37, heel post guidance slots 74 are formed which are shaped to receive heel sleeve guidance formations 72 on the removable heel sleeve 30. Heel post guidance slots 74 each have an aperture which is orientated downward such when the removable heel sleeve 30 is slid onto the heel post 34, the heel sleeve guidance formations 72 are inserted into the guidance slots 74. In an alternative embodiment, the heel post biasing member 46 may be in the form of a coil spring.

Figure 6:
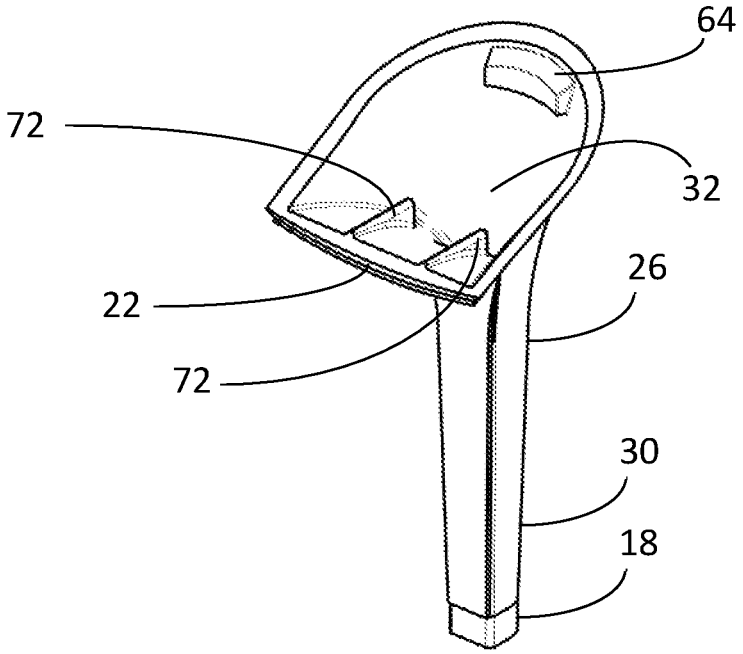
FIG. 6 shows a schematic isometric view of a heel sleeve for use in the interchangeable heel according to the invention.
Figure 7:
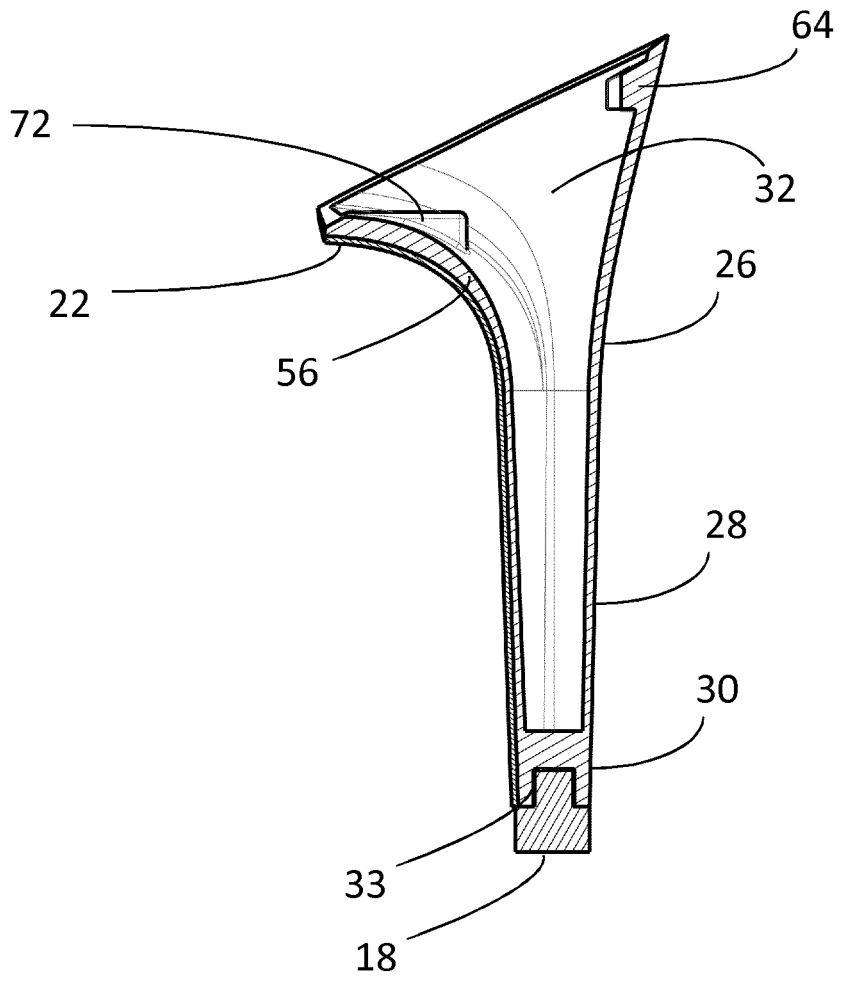
FIG. 7 shows a schematic cross-sectional view of a heel sleeve for use in the interchangeable heel according to the invention.

Removable heel sleeve 30 is shown in more detail in FIGS. 6 and 7. Removable heel sleeve 30 has an upper part 26 and a lower part 28. Upper part 26 of removable heel sleeve 30 forms a heel sleeve aperture 32 for receiving the heel post 34. The base of the lower part 28 of removable heel sleeve 30 forms a heel sleeve recess 33 for receiving heel tip 18. On the upper part 26 of removable heel sleeve 30, corresponding parts of the opposed lock mechanism 41 are provided. On the shoe back side 13 of the angled head 35 of upper part 26 of removable heel sleeve 30, a heel sleeve catch formation 64 is provided which is shaped to engage with the heel post catch aperture 62. Heel sleeve catch formation 64 is formed from a thermoplastic material such as an engineering thermoplastic, e.g. polyoxymethylene (POM), acrylonitrile butadiene styrene (ABS), polycarbonate, and/or polyamide (nylon, such as nylon 6 or nylon 66). On the opposing side of the upper part 26 of removable heel sleeve 30, a heel sleeve lock formation 56 is provided on curved heel breast 22 to engage with the heel post biasing member 46. On the heel sole side of angled head 35 of upper part 26 of heel sleeve, heel sleeve guidance formations 72 are provided to each side of heel sleeve lock formation 56. Heel sleeve guidance formations 72 are fin-shaped so as to be suitable for engaging heel sleeve guidance slots 74 on the heel post 34.

The opposed lock mechanism 41 comprises a heel catch mechanism 60 which is provided on the rear side of the heel 10 and a heel lock mechanism 45 which is provided on the heel breast 22 (in other words the front side of the heel 10) such that they are provided on opposite sides of the interchangeable heel 10. Heel catch mechanism 60 comprises the catch aperture 62 formed by the heel post 34 and the catch formation 64 on the removable heel sleeve 30. Heel lock mechanism 45 comprises heel sleeve lock formation 56, heel post biasing member 46, and heel post lock aperture 37. The heel post guidance slots 74 and heel sleeve guidance formations 72 form an anti-twist mechanism indicated generally at 71 on FIG. 3. The guidance slots 74 and guidance formations 72 are arranged to have a length which is substantially parallel to a line drawn between the heel catch mechanism 60 and the heel lock mechanism 45 such that the anti-twist mechanism 71 does not present any resistance to any movement of removable heel sleeve 30 along that line to disengage removable heel sleeve 30 from heel post 34 but the anti-twist mechanism 71 otherwise provides resistance to any other movement of removable heel sleeve 30 in relation to heel post 34.

In an alternative embodiment, heel catch mechanism 60 may comprise a catch aperture 62 which is formed on an internal surface of removable heel sleeve 30 and a catch formation 64 which is provided on the heel post 34.

In use, the opposed lock mechanism 41 and the anti-twist mechanism 71 are engaged when the removable heel sleeve 30 is mounted on heel post 34. The heel sleeve lock formation 56 engages the heel post biasing member 46 such that the biasing member 46 is forced into the heel post lock aperture 37 to activate the heel lock mechanism 45. The heel sleeve catch formation 64 engages with the heel post catch aperture 62 to activate the heel catch mechanism 60. The heel sleeve guidance formations 72 engage with the heel post guidance slots 74 such that the removable heel sleeve 30 cannot be rotated relative to the heel post 34. The biasing member 46 urges the heel sleeve lock formation 56 in the direction of the shoe sole 16 such that the biasing member 46 urges the heel sleeve catch formation 64 to engage the heel post catch aperture 62.

To release the opposed lock mechanism 41, pressure may be applied to the heel sleeve lock formation 56 to force the heel post biasing member 46 further into the heel post lock aperture 37 and at the same time the removable heel sleeve 30 is rotated away from the heel sole 16 such the heel sleeve catch formation 64 disengages the heel post catch aperture 62 such that the removable heel sleeve 30 may be removed from the heel post 34 such that the heel sleeve guidance formations 72 are slid out of heel post guidance slots 74.

One of the advantages of the interchangeable heel 10 according to the invention is that it passes the SATRA TM113 Heel Attachment test protocol (1996). In this test, the shoe 12 shown in FIG. 1 is mounted in a tensile testing machine by attaching the lower part 28 of the heel 10 to an upper clamp attachment 20, just above shoe heel tip 18 and attaching the sole 16 to a lower clamp 21. A reference distance between the shoe heel tip 18 and the lower clamp 21 is measured and recorded as [D0]. The tensile testing machine is then operated at a jaw separation rate of 100±10 mm/min to apply a force to move heel 10 away from shoe sole 16 until a force of 200N has been applied. The reference distance is measured again without releasing the force and is recorded as [D1]. The tensile testing machine is restarted and is operated until a force of 400N has been applied. The reference distance is measured again without releasing the force and is recorded as [D2]. The tensile testing machine is operated again until the shoe 12 fails.

In a first test using the SATRA TM113 Heel Attachment test protocol (1996), the shoe sole 16 failed at a tensile force of 600N by buckling before heel 10 failed. This is believed to be because the application of force in a direction away from the shoe sole 16 to the lower part 28 of heel 10 creates a countervailing force to the upper part 26 of heel 10 such that the heel sleeve catch formation 64 is urged by that countervailing force to engage heel post catch aperture 62.

In a second test using a shoe 12 with a different type of shoe sole 16 and the SATRA TM113 Heel Attachment test protocol (1996), the results were (with a tolerance of ±3%) initial distance DO was 143 mm, distance D2 measured at a force of 400N was 145 mm, the permanent set (calculated as the difference between D2 and D0) was 1.9%, and the maximum heel attachment load was 1005.3N. The second test was performed at 23° C.±2° C. and 50% rH±4% rH.

These results pass the specifications set by UK shoe retailers who require a maximum 15% permanent set and a minimum 600N heel attachment load.

The invention claimed is:

1. An interchangeable heel for a shoe wherein the interchangeable heel comprises a removable heel sleeve and a heel post which is mounted on the shoe wherein the heel sleeve is releasably mounted on the heel post by an opposed lock mechanism which comprises a catch mechanism on one side of the interchangeable heel and a biasing mechanism on an opposite side of the interchangeable heel wherein the biasing mechanism comprises a biasing member which is provided on the heel post wherein the biasing member is arranged to engage the removable heel sleeve and wherein the biasing member of the biasing mechanism is on an opposite side of the heel post to the catch mechanism.

2. A heel as defined in claim 1 wherein the heel catch mechanism comprises a catch aperture and a catch formation.

3. A heel as defined in claim 1 wherein the biasing mechanism comprises lock formation provided on the removable heel sleeve, the biasing member, and a heel post lock aperture shaped to receive the biasing member.

4. A heel as defined in claim 1 wherein the interchangeable heel comprises an upper heel and a lower heel and the opposed lock mechanism is provided on the upper heel.

5. A heel as defined in claim 1 wherein the opposed lock mechanism is provided on the front and rear sides of the heel.

6. A heel as defined in claim 1 wherein the catch mechanism is provided on the rear side of the heel and the biasing mechanism is provided on the front side of the heel.

7. A heel as defined in claim 1 wherein the biasing member is in the form of a leaf spring or a coil spring.

8. A heel as defined in claim 1 wherein the biasing mechanism comprises a biasing member and a lock aperture formed on the heel post and shaped to receive the biasing member.

9. A heel as defined in claim 8 wherein the biasing member is in the form of leaf spring and is attached to the heel post above the lock aperture; or wherein the biasing member is in the form of a coil spring and is attached within lock aperture.

10. A heel as defined in claim 1 wherein the biasing member is provided on a heel breast of the heel post.

11. A heel as defined in claim 1 wherein the catch mechanism comprises a catch formation provided on one of the heel post or heel sleeve and a catch aperture shaped to receive the catch formation formed by the other of the heel post or heel sleeve.

12. A heel as defined in claim 11 wherein the heel post has an angled head surface for engaging the shoe sole and the catch aperture is provided on a rear side of the angled head surface.

13. A heel as defined in claim 11 wherein the removable heel sleeve has an angled head for engaging the shoe sole and the catch mechanism comprises a catch formation which is provided on a rear side of the angled head of the removable heel sleeve.

14. A heel as defined in claim 1 wherein the removable heel sleeve forms a heel sleeve aperture for receiving the heel post.

15. A heel as defined in claim 1 wherein the removable heel sleeve has a lock formation for engaging the biasing member.

16. A heel as defined in claim 1 which comprises an anti-twist mechanism which comprises one or more guidance slots provided on one of the heel post and heel sleeve and one or more guidance formations provided on the other of the heel post and heel sleeve.

17. A heel as defined in claim 16 wherein the guidance slots are shaped to receive the guidance formations and to facilitate movement of the heel sleeve to remove it from the heel post but to prevent other movement of the heel sleeve.

18. A heel as defined in claim 16 wherein the one or more guidance slots is provided on the heel post and wherein the one or more guidance formations are provided on the removable heel sleeve.

19. A shoe comprising an interchangeable heel for a shoe wherein the interchangeable heel comprises a removable heel sleeve and a heel post which is mounted on the shoe wherein the heel sleeve is releasably mounted on the heel post by an opposed lock mechanism which comprises a catch mechanism on one side of the interchangeable heel and a biasing mechanism on an opposite side of the interchangeable heel wherein the biasing mechanism comprises a biasing member which is provided on the heel post wherein the biasing member is arranged to engage the removable heel sleeve and wherein the biasing member of the biasing mechanism is on an opposite side of the heel post to the catch mechanism.

20. A heel sleeve for use in the interchangeable heel as defined in claim 1 wherein the heel sleeve forms a catch formation or a catch aperture to form part of an opposed lock mechanism such that the heel sleeve may engage the heel post of the interchangeable heel.

21. A heel sleeve for use in the interchangeable heel as defined in claim 1 wherein the heel sleeve forms a catch formation or a catch aperture to form part of an opposed lock mechanism such that the heel sleeve may engage the heel post of the interchangeable heel.

* * * * *